US010526856B2

(12) United States Patent
Hern et al.

(10) Patent No.: US 10,526,856 B2
(45) Date of Patent: Jan. 7, 2020

(54) HYDRAULICALLY SET OPEN HOLE WHIPSTOCK

(71) Applicant: BAKER HUGHES, A GE COMPANY, LLC, Houston, TX (US)

(72) Inventors: Gregory L. Hern, Porter, TX (US); James S. Trahan, Magnolia, TX (US); Jason L. Cullum, League City, TX (US); Ewoud J. Hulsewe, The Woodlands, TX (US); Christopher R. Hern, Porter, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 245 days.

(21) Appl. No.: 15/428,955

(22) Filed: Feb. 9, 2017

(65) Prior Publication Data

US 2018/0223614 A1 Aug. 9, 2018

(51) Int. Cl.

| | |
|---|---|
| ***E21B 23/01*** | (2006.01) |
| ***E21B 7/06*** | (2006.01) |
| ***E21B 34/06*** | (2006.01) |
| ***E21B 23/04*** | (2006.01) |

(52) U.S. Cl.

CPC ..... *E21B 23/01* (2013.01); *E21B 7/061* (2013.01); *E21B 23/04* (2013.01); *E21B 34/06* (2013.01)

(58) Field of Classification Search

CPC ..... E21B 23/01; E21B 7/061

See application file for complete search history.

(56) References Cited

U.S. PATENT DOCUMENTS

| | | | | |
|---|---|---|---|---|
| 4,765,404 | A * | 8/1988 | Bailey | E21B 7/061 166/117.6 |
| 5,443,129 | A * | 8/1995 | Bailey | E21B 7/061 166/117.6 |
| 5,467,821 | A * | 11/1995 | Sieber | E21B 7/061 166/123 |
| 5,566,762 | A * | 10/1996 | Braddick | E21B 7/061 166/117.6 |
| 5,743,331 | A * | 4/1998 | Adkins | E21B 21/10 166/117.6 |
| 6,138,756 | A * | 10/2000 | Dale | E21B 29/00 166/117.5 |
| 6,209,635 | B1 * | 4/2001 | Gotlib | E21B 7/061 166/117.5 |
| 6,364,037 | B1 * | 4/2002 | Brunnert | E21B 7/061 166/324 |

(Continued)

*Primary Examiner* — Shane Bomar

(74) *Attorney, Agent, or Firm* — Shawn Hunter

(57) ABSTRACT

A BHA features an MWD tool connected to a running tool supporting a whipstock that is connected to an open hole anchor. The anchor is flow set and after the anchor is set the running tool collets release from the whipstock to allow cement to be pumped through the anchor to hold the set position. The collets are released from the whipstock also with flow and after the anchor has been set. One way is to use nozzles in series. Another is to run in with a ball on the anchor seat, set the anchor and blow out the ball seat so flow can again be used to release the running tool collets. Another is suspending a ball above the anchor seat, releasing the ball with pressure cycle, open another flow passage to allow collet release of the whipstock. Finally, pressure can be used to release the running tool collets.

12 Claims, 8 Drawing Sheets

(56) References Cited

U.S. PATENT DOCUMENTS

| | | | | |
|---|---|---|---|---|
| 8,833,442 | B2 * | 9/2014 | Ibragimov | E21B 7/061 166/117.6 |
| 8,915,296 | B2 * | 12/2014 | McGarian | E21B 7/06 166/255.3 |
| 2003/0183388 | A1 * | 10/2003 | Toulouse | E21B 4/02 166/298 |
| 2004/0069496 | A1 * | 4/2004 | Hosie | E21B 7/061 166/373 |
| 2009/0266544 | A1 * | 10/2009 | Redlinger | E21B 4/02 166/298 |
| 2014/0338908 | A1 * | 11/2014 | Ervin | E21B 33/13 166/285 |
| 2018/0320448 | A1 * | 11/2018 | Hern | E21B 29/06 |
| 2019/0093436 | A1 * | 3/2019 | Costa de Oliveira | E21B 23/04 |
| 2019/0330944 | A1 * | 10/2019 | Crabb | E21B 7/061 |

* cited by examiner

HYDRAULICALLY SET OPEN HOLE WHIPSTOCK

FIELD OF THE INVENTION

The field of the invention is open hole whipstock and anchor assemblies that can be oriented with measurement while drilling (MWD) equipment that precludes ball dropping and more particularly with actuation happening with flow actuated systems that do not stress the surface pumping equipment or exceed the rated pressure of system components.

BACKGROUND OF THE INVENTION

Currently after an anchor is set to hold an open hole whipstock in place, the running tool is released from the whipstock by dropping a ball and applying hydraulic pressure against the ball to shift a piston. After the piston is displaced a collet on the running tool will deflect inward and allow the running tool to be removed from the whipstock. The requirement to drop the ball from surface means that Measurement While Drilling (MWD) cannot be used to orient the whipstock. The improved system allows the running tool to be disengaged from the whipstock without dropping a ball from surface.

The pump through Bigfoot Anchor made by Baker Hughes Incorporated was created so that cement can be pumped through the whipstock on the same run that the anchor is set. This is done by lowering the whipstock assembly to depth and then using wireline to lower a gyro into the assembly to orient the face of whipstock. After the whipstock is oriented the gyro is retrieved to surface. A ball is then dropped from surface so that hydraulic pressure can be applied against the ball to move a piston to set the anchor. Pressure is then increased until a rupture disc is broken. A second ball is dropped so that hydraulic pressure can be applied to shift a piston that is supporting a collet that attaches the running tool to the whipstock. After the running tool is released cement can be pumped through the rupture disc to cement the anchor in place. This system is limited by the fact that balls must be dropped from surface, which prevents the use of MWD. Because gyros are run on wireline they cannot be used on highly deviated or horizontal wells. The present invention modifies the pistons in the anchor and whipstock so that they can be activated by using pressure drop though nozzles to break the shear screws that hold the pistons in place. A whipstock valve is added to the system. With the new configuration a ball is on seat in the pump through Bigfoot Anchor when tripping in hole. The whipstock valve provides a flow path to the annulus. After MWD has oriented the face of the whipstock, flow rate is increased to break the shear screws in the whipstock valve so that the annular ports can be closed. Pressure can now be applied to set the anchor. After the anchor has been set a flow path to the annulus is created. This can be done by extruding the ball through the ball seat, having the ball seat release from the piston assembly, or opening a rupture disc. Once the flow path is created pressure drop through a nozzle in the piston in the whipstock will break the shear screws holding the piston in place. This will release the collet holding the running tool in place. Cement can now be pumped through the port in the anchor to cement the anchor in place. Debris could be a problem with this solution. Since the whipstock valve is the only flow path to the annulus fluid cannot be pumped through the anchor to displace debris when lowering the assembly into the hole.

Another solution would be to not have a ball on seat in the anchor when positioning the assembly into the well. That is, the anchor is set by pressure drop through a nozzle, and the running tool is also released by pressure drop through another nozzle. This allows flow all the way through the anchor, and will reduce the debris issue. The problem with this solution is that the anchor activation must happen at a higher flow rate that is required for MWD readings, and an even higher flow rate is required to shift the piston to release the running tool from the whipstock. To make sure that the anchor is set securely requires 3,000 psi pressure acting on the piston. An even higher pressure will be created when the flow rate is increased to shift the piston that releases the running tool. When adding these two pressure requirements to pressure drop through the drill string, standpipe pressure at surface could be higher than is desired.

Various configurations are envisioned that are flow sensitive for sequential settings of the anchor and subsequent release of the collets holding the running tool to the whipstock. Cement placement through the anchor is enabled with the running tool released from the whipstock so that it can be removed after cementing the anchor. Flow for MWD orientation purposes for the whipstock is enabled as are sequential operation of the anchor and then the release of the running tool while keeping the running tool in position to deliver cement and release from the whipstock. No balls are needed, which would impeded the operation of the MWD unit in orienting the whipstock. These and other aspects of the present invention will be more readily understood from a review of the description of the preferred embodiment and the associated drawings while recognizing that the full scope of the invention is to be determined from the appended claims.

SUMMARY OF THE INVENTION

A BHA features an MWD tool connected to a running tool supporting a whipstock that is connected to an open hole anchor. The anchor is flow set and after the anchor is set the running tool collets release from the whipstock to allow cement to be pumped through the anchor to hold the set position. The collets are released from the whipstock also with flow and after the anchor has been set. One way is to use nozzles in series. Another is to run in with a ball on the anchor seat, set the anchor and blow out the ball seat so flow can again be used to release the running tool collets. Another is suspending a ball above the anchor seat, releasing the ball with pressure cycle, open another flow passage to allow collet release of the whipstock. Finally, pressure can be used to release the running tool collets.

BRIEF DESCRIPTION OF THE DRAWINGS

FIG. 22 is the bottom hole assembly being run in;

DETAILED DESCRIPTION OF THE PREFERRED EMBODIMENT

Figure 1:
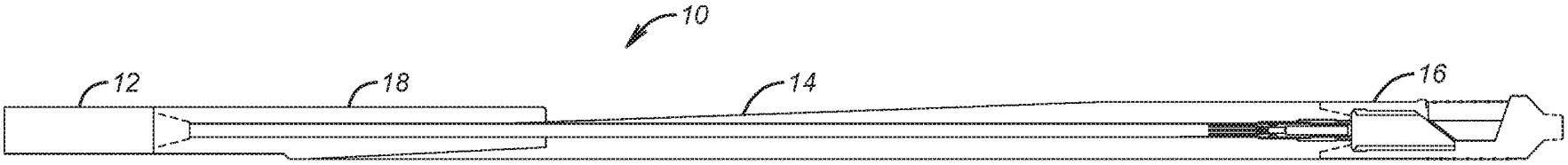
FIG. 1 shows the bottom hole assembly prior to setting the anchor.
Figure 2:
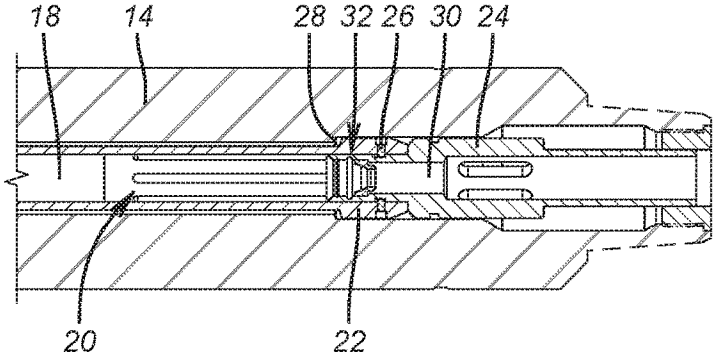
FIG. 2 is an enlarged view of the collets of the running tool locked by a piston when orienting the whipstock.

FIG. 1 illustrates a bottom hole assembly (BHA) 10 comprising a measurement while drilling orientation tool (MWD) 12 connected to a whipstock 14 followed by an anchor 16. The whipstock 14 and anchor 16 collectively comprise an oriented tool assembly. A running tool 18 runs into the whipstock 14 and has a collet assembly 20 at its lower end as shown in FIG. 2. The assembly 20 has spaced collet heads 22 initially secured to a piston 24 with shear pins 26. Collet heads 22 are against shoulder 28 on whipstock 14 such that piston 24 retains the running tool 18 to the whipstock 14 until it is time to release, as will be explained below. Piston 24 has flow passage 30 so that flow can be passing through the MWD 12 to properly orient the whipstock 14 when it is located at the needed location. A flow restriction 32 allows the application of mechanical force to piston 24 at a predetermined flow rate.

Figure 3:
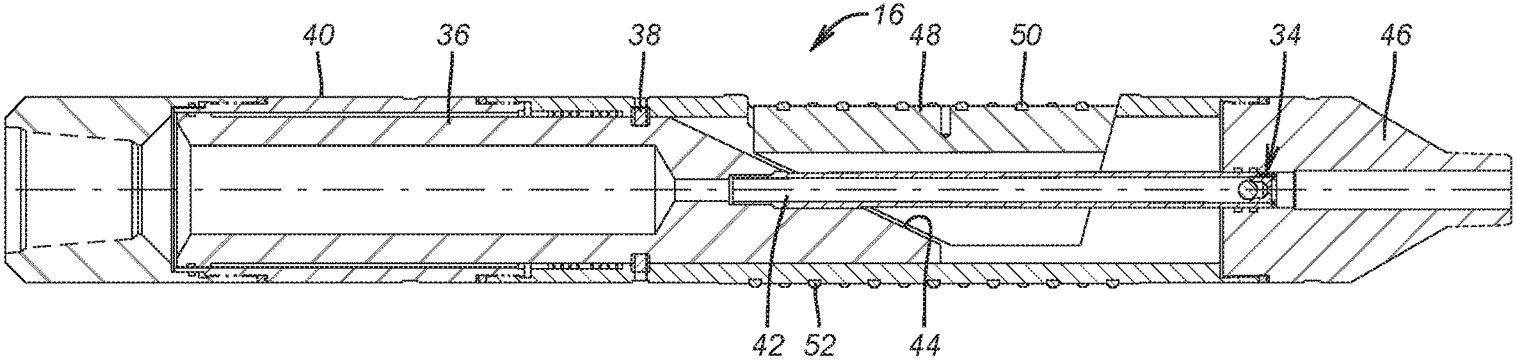
FIG. 3 is a section view of the anchor when the whipstock is oriented with the MWD tool.
Figure 4:
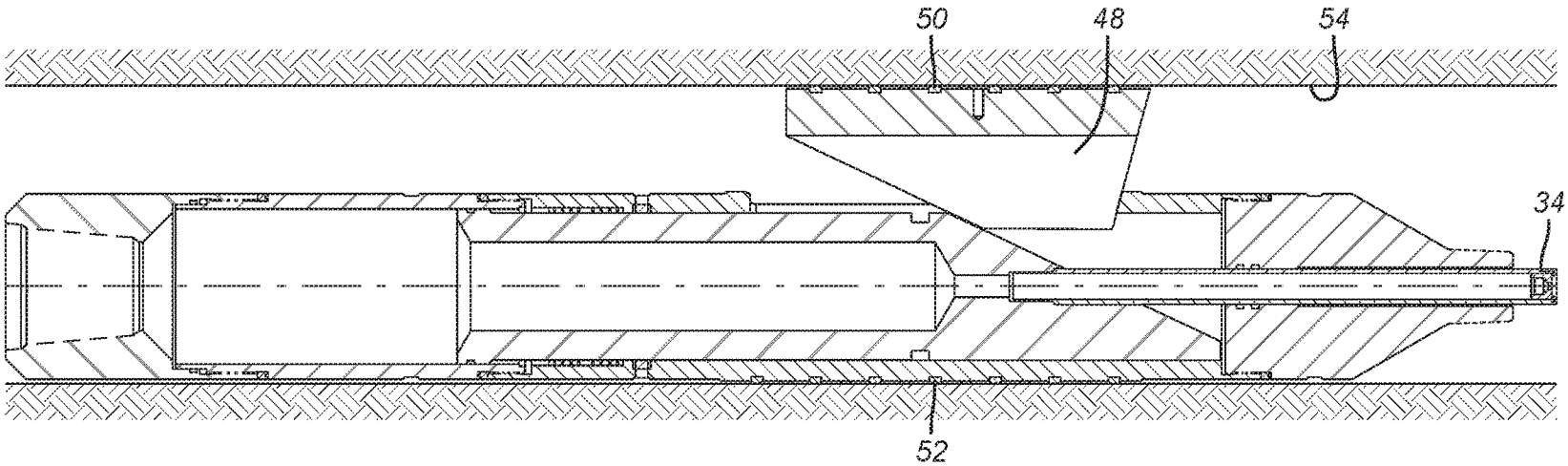
FIG. 4 is the view of FIG. 3 with the anchor set.

A lower flow restriction or orifice 34 is in anchor 16 as shown in FIG. 3. Piston 36 is originally shear pinned at 38 to the anchor housing 40. Initial flow into passage 42 through restriction 34 breaks shear pin 38 and advances ramp 44 toward bottom sub 46 extends slip 48 to contact the borehole wall with hard particles 50. The extension of slip 48, shown in FIG. 4, brings hard particles 52 in housing 40, located opposite slip 48 into the borehole wall 54 as well.

Figure 5:
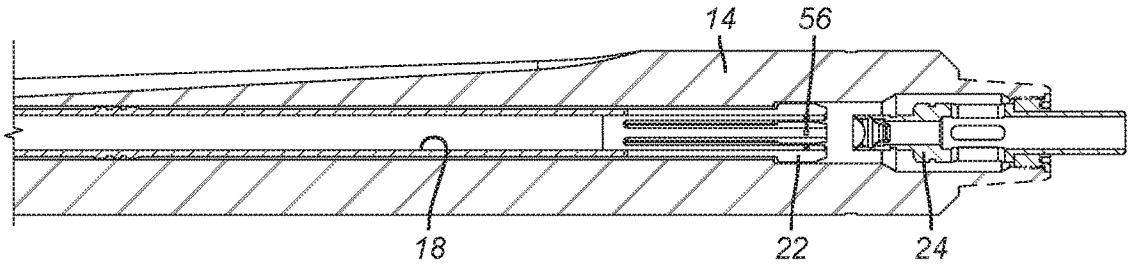
FIG. 5 shows the running tool collets released after the anchor is set.
Figure 6:
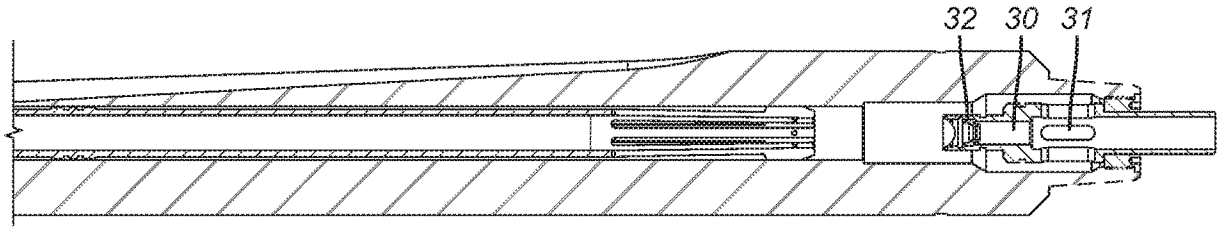
FIG. 6 shows the running tool picked up before cementing starts.

Further increasing the flow rate allows shear pins 26 that extend through collet heads 22 to shear as a result of force applied to piston 24 from flow through orifice 32. As shown in FIG. 5 the piston 24 is pushed to a travel stop on the whipstock 14, which releases the running tool 18 from the whipstock 14 while leaving the heads 22 in whipstock passage 56. FIG. 6 shows the component position with cement being delivered to the anchor 16 to fixate its set position. The cement flows through orifice 32 and openings 31 in piston 24 and orifice 34 to get to the anchor 16. The running tool 18 is pulled out with the MWD 12 after cement is delivered. Release of the collet heads 22 from the whipstock 14 is confirmed before cement or another sealing material is delivered.

Figure 7:
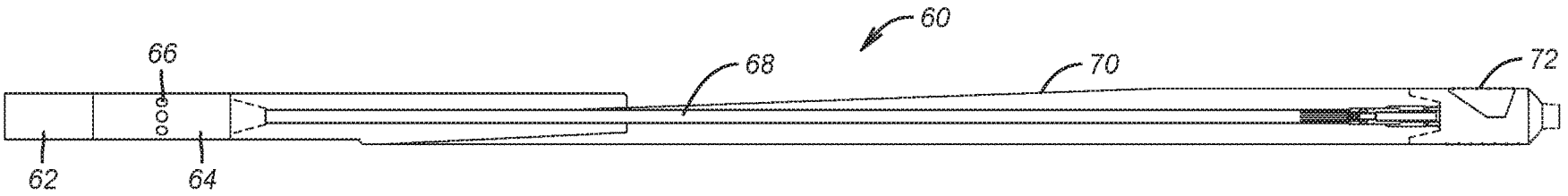
FIG. 7 is another view of a bottom hole assembly using a whipstock valve.
Figure 8:
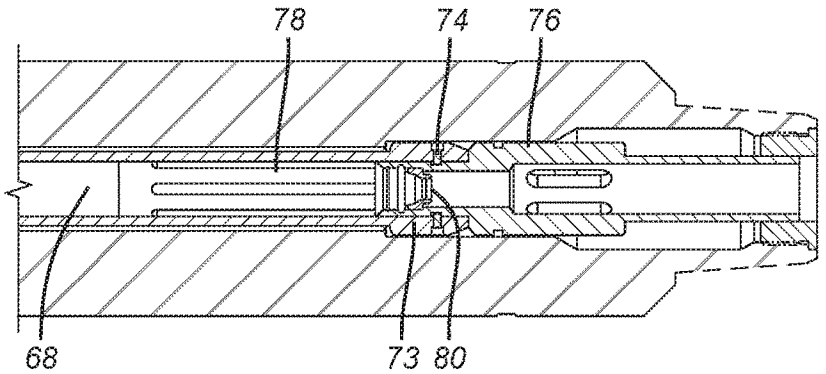
FIG. 8 is an enlarged view of the collets of the running tool locked by a piston when orienting the whipstock.
Figure 9:
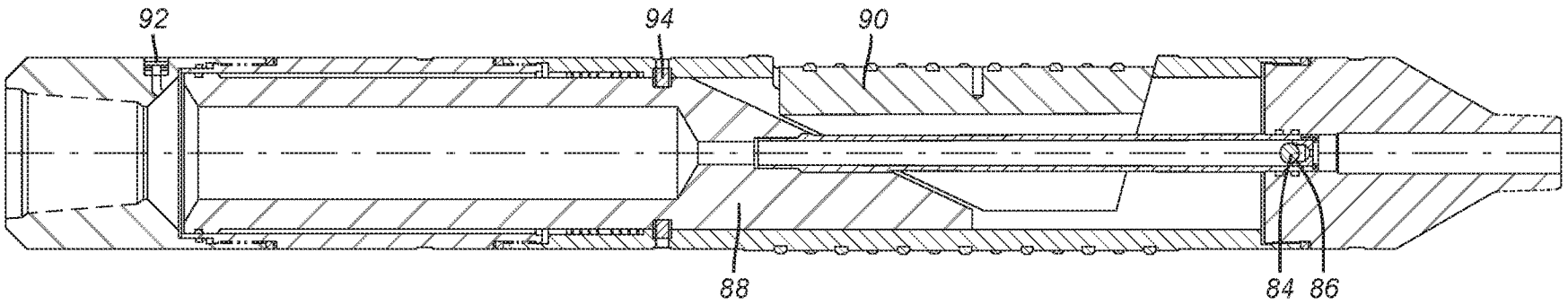
FIG. 9 shows a ball on seat delivered with the anchor.
Figure 10:
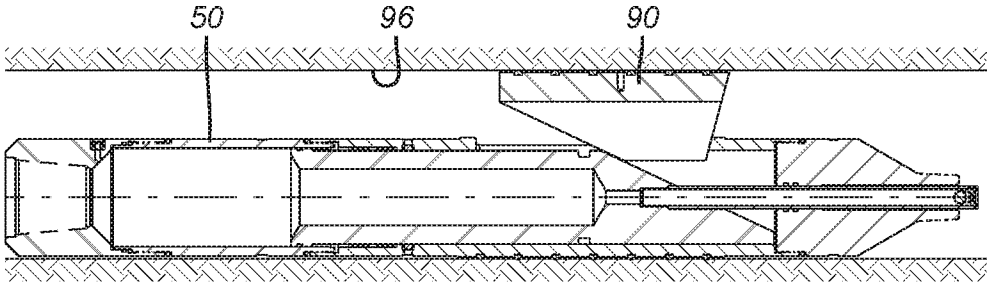
FIG. 10 shows the anchor set with pressure.
Figure 11:
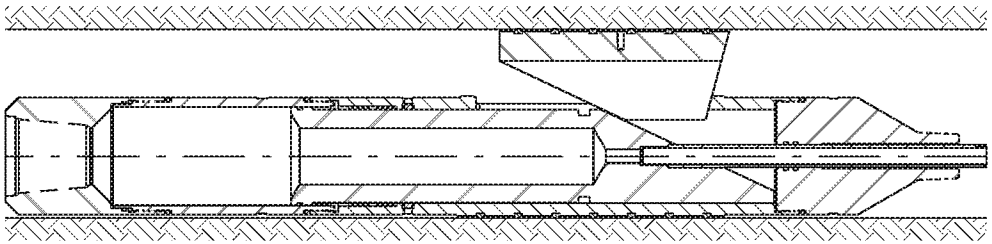
FIG. 11 shows the ball and seat blown out of the set anchor.
Figure 12:
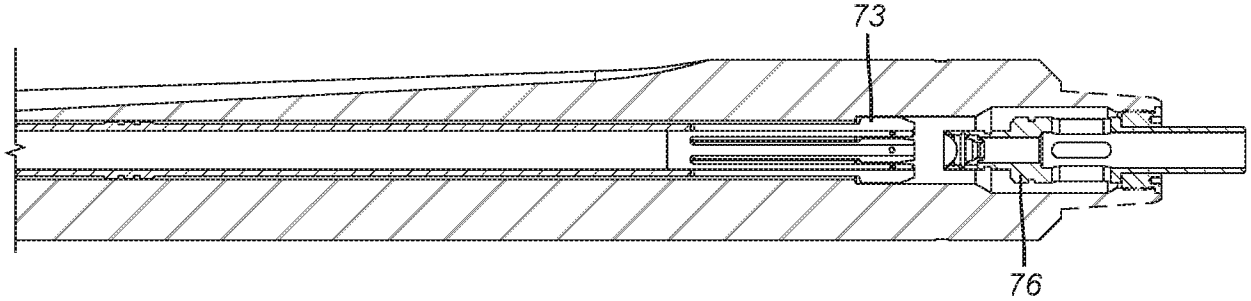
FIG. 12 shows the running tool collets released after the anchor is set.
Figure 13:
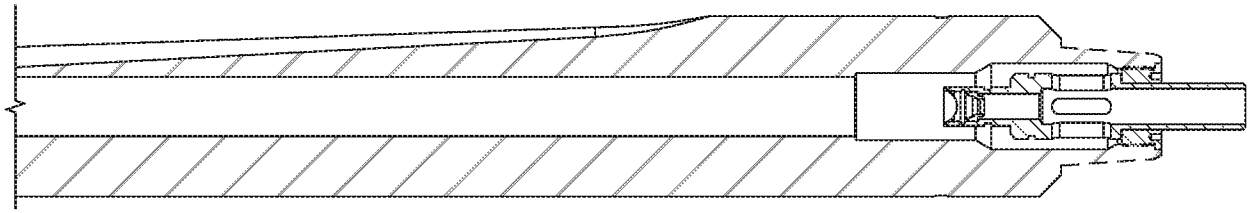
FIG. 13 shows the running tool removed after cementing.

FIG. 7 illustrates a modified BHA from that shown in FIG. 1. In FIG. 7 there is the MWD tool 62 followed by a whipstock valve 64. The whipstock valve 64 is a flow cycle responsive valve that can let flow out laterally through openings 66 while preventing flow straight through into running tool 68 that passes through the whipstock 70. An anchor 72 is connected to the whipstock 70. As before, the lower end of the running tool 68 has a collet assembly 78 with heads 72 pinned at shear pins 74 to piston 76. Flow goes through restriction 80 and through passage 82 when the whipstock valve 64 is aligned for straight through flow rather than out laterally to openings 66. Ball 84 is run in on seat 86. Movement of slip piston 88 pushes out slip 90 to contact the open hole borehole wall. The order of operation is that openings 66 provide a flow path in that the MWD device 62 can orient the whipstock 70. When that is accomplished a pressure cycle shifts whipstock valve 64 to straight through flow configuration and closes the ports 66. Pressure can then be built up on the ball 84 seated on seat 86 to drive the slip piston 88 against slip 90 to extend slip 90 radially outwardly against the surrounding borehole wall as shown in FIG. 10. FIG. 11 shows the ball 84 and its associated seat 86 blown out so that flow through restriction 80 can move piston 76 to break shear pins 74 to unlock heads 73 as piston 76 moves out from under heads 73. This releases the running tool 68 from the whipstock 70 as shown in FIG. 12. Ultimately after the set anchor 72 is cemented, the running tool 68 will come out with the whipstock valve 64 and the MWD unit 62. In the event the ball 84 and seat 86 refuse to release and blow out, a rupture disc 92 shown in FIG. 9 can be broken with raised pressure to allow flow through restriction 80 to move piston 76 to release collet heads 72 on the running tool 68. FIG. 13 shows the running tool 68 removed from the whipstock 70. Shear pin 94 is broken by initial movement of the slip piston 88 to drive the slip 90 against the borehole wall 96 as shown in FIG. 10. In all other respects the anchor 72 is similar to anchor 16 described above.

Figure 14:
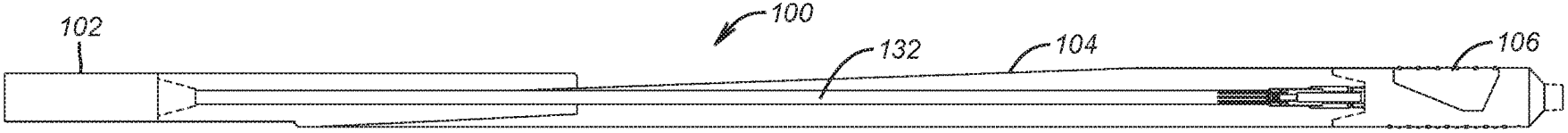
FIG. 14 is an overview of a bottom hole assembly.
Figure 15:
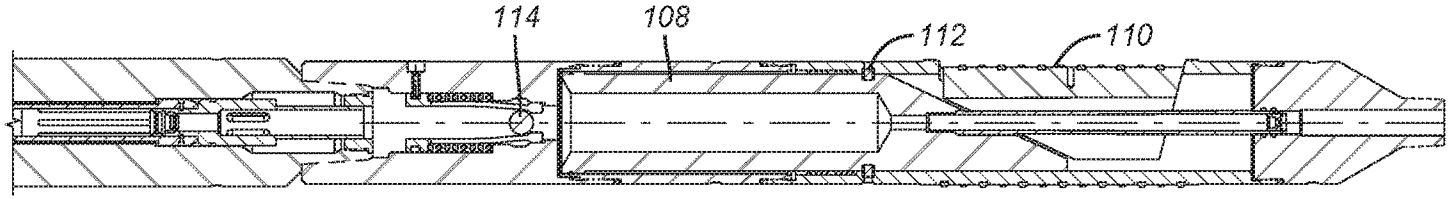
FIG. 15 is a section view of the whipstock and anchor during whipstock orientation with the MWD.
Figure 16:
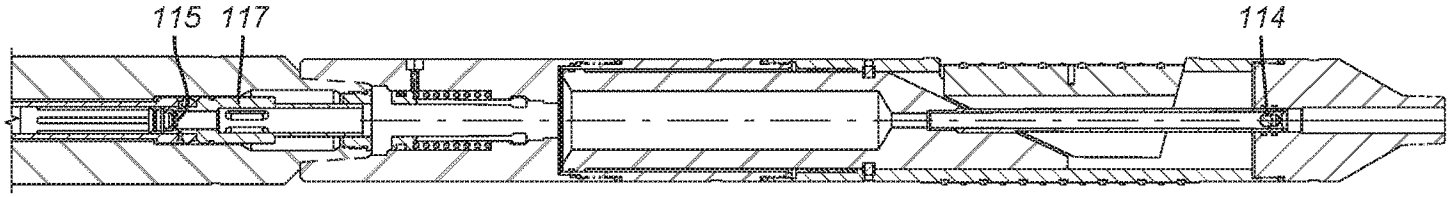
FIG. 16 shows a ball released into the anchor ball seat from a collet above the anchor piston.
Figure 18:
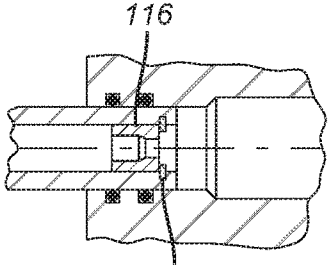
FIG. 18 is an enlarged view of the anchor ball seat showing a shear ring support.
Figure 17:
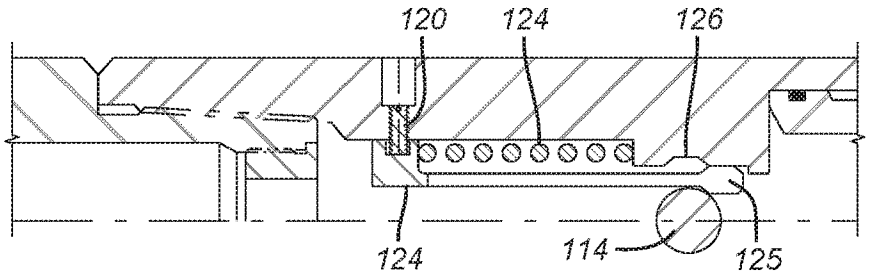
FIG. 17 is a detail of the ball release mechanism before the shear pin breaks under pressure.
Figure 19:
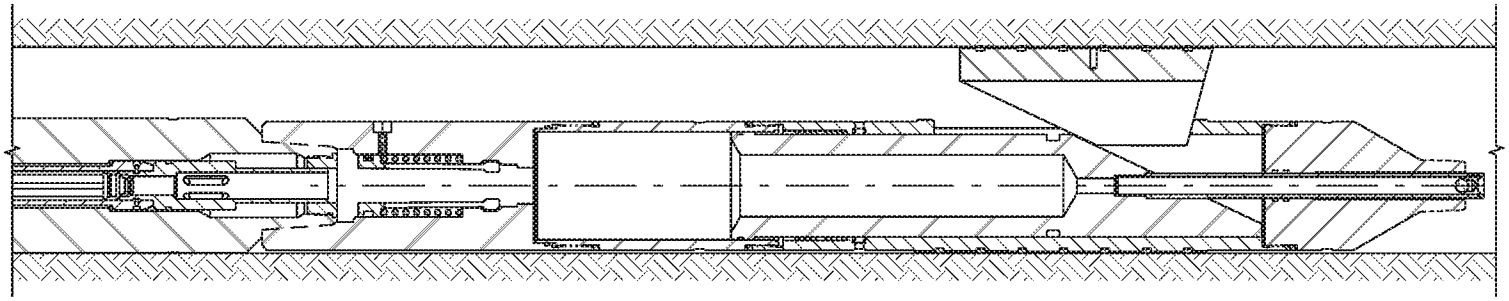
FIG. 19 shows the anchor set with pressure on the seated ball.
Figure 20:
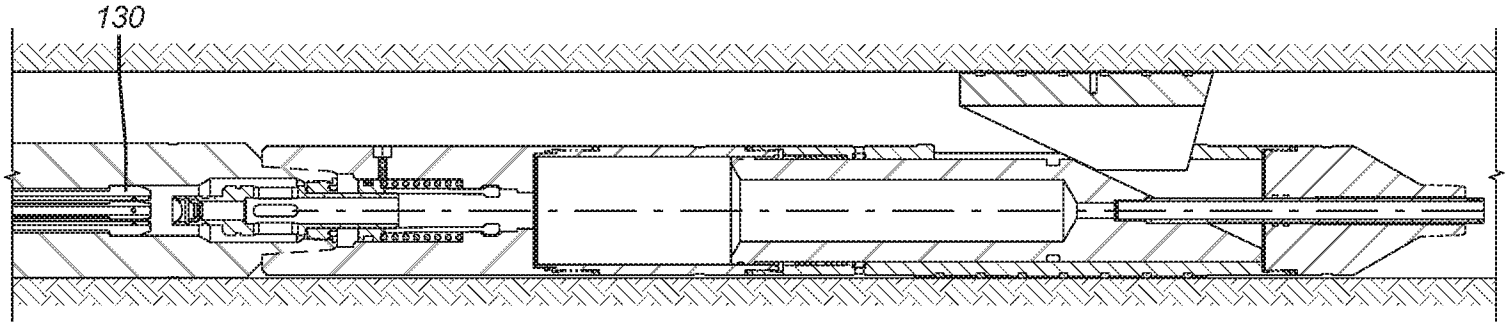
FIG. 20 shows reestablishing flow with blowing the ball and seat or opening a lateral passage with a rupture disc.
Figure 21:
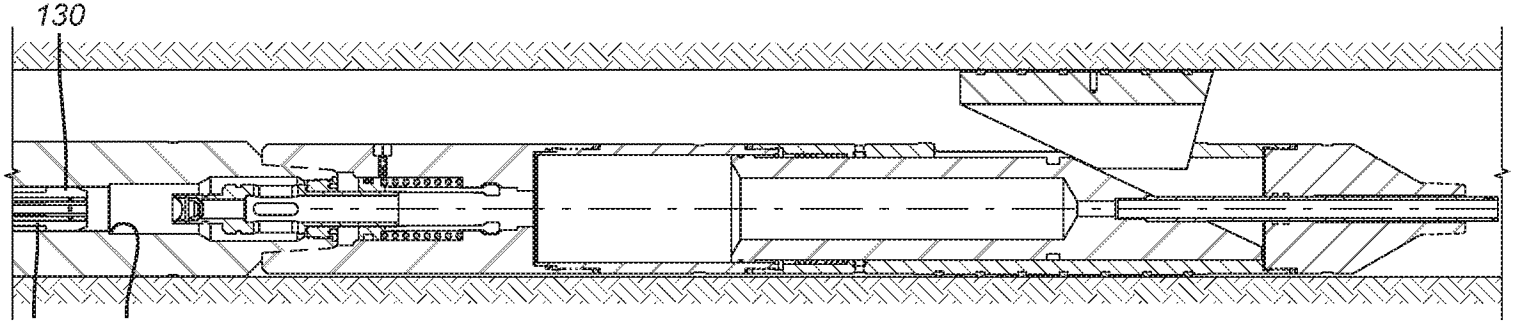
FIG. 21 is the view of FIG. 20 with the running tool released and removed.

FIG. 14 shows a bottom hole assembly 100 that has an MWD unit 102 followed by a whipstock 104 and an anchor 106. Anchor 106 has a piston 108 whose axial movement extends slip 110 as shear pin 112 is broken. Piston 108 moves when ball 114 is released to travel to seat 116. As shown in FIG. 17, piston 118 is initially shear pinned at pin 120. Flow through collets 125 creates internal pressure against ball 114 which breaks the pin 120 and moves the piston 117 to stop 122. As long as flow through collets 125 creates enough pressure to keep spring 124 compressed, the ball 114 does not release. However, when flow is removed the spring 124 pushes piston 118 upward which allows the collets 125 to go into recess 126 to release the ball 114. The reason for doing it this way is to avoid release of the ball 114 when it is subject to high flow rates that would cause ball 114 to impact ball seat 116 at high velocity which would cause ball 114 to extrude through the ball seat 116, or cause the release of ball seat 116 by breaking shear ring 128. Thus, a cycle of application and removal of flow induced pressure against ball 114 causes its release. The released ball 114 moves to seat 116 shown in FIG. 16. FIG. 19 shows the ball 114 released and landed on seat 116 and pressure applied to extend slip 110. Further pressure buildup with the slip 110 extended blows out the ball 114 with seat 116. FIG. 18 is an enlarged view to show the shear ring 128 to allow ball 114 and seat 116 to be blown out together to enable flow through restriction 115 to move piston 118 for release of the collet heads 130 as shown in FIG. 20. In FIG. 21, after confirming running tool 132 can be removed by pulling collet head 130 past shoulder 134 cement can be run through the BHA, followed by extracting the running tool 132 out of the whipstock 104 to complete the operation.

Figure 22:
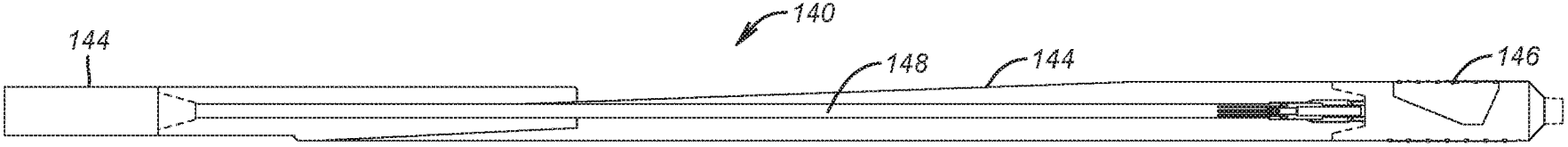
Figure 23:
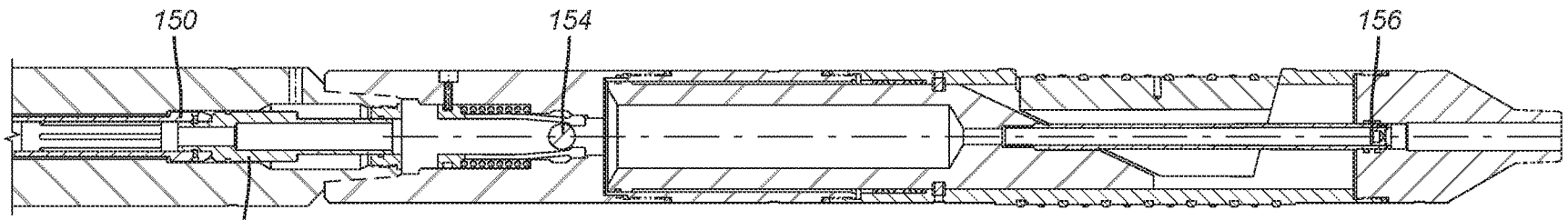
FIG. 23 is a section view of the whipstock and anchor during orientation with the MWD.
Figure 24:
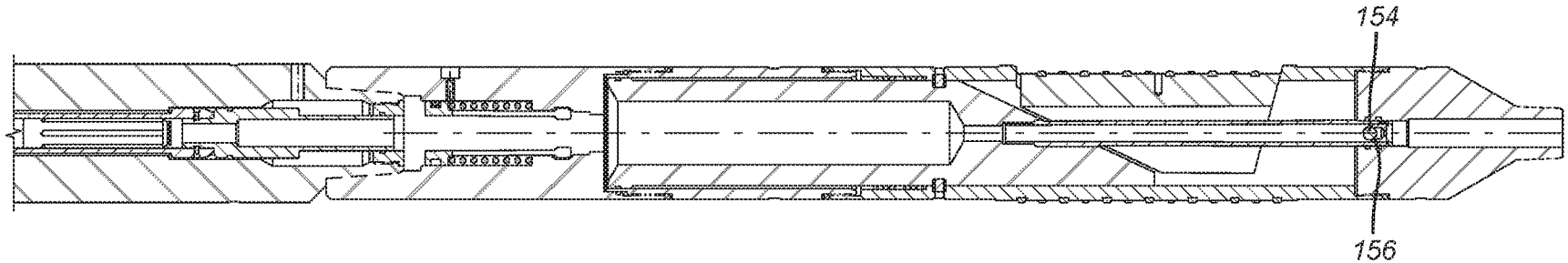
FIG. 24 shows the ball released into the anchor ball seat.
Figure 25:
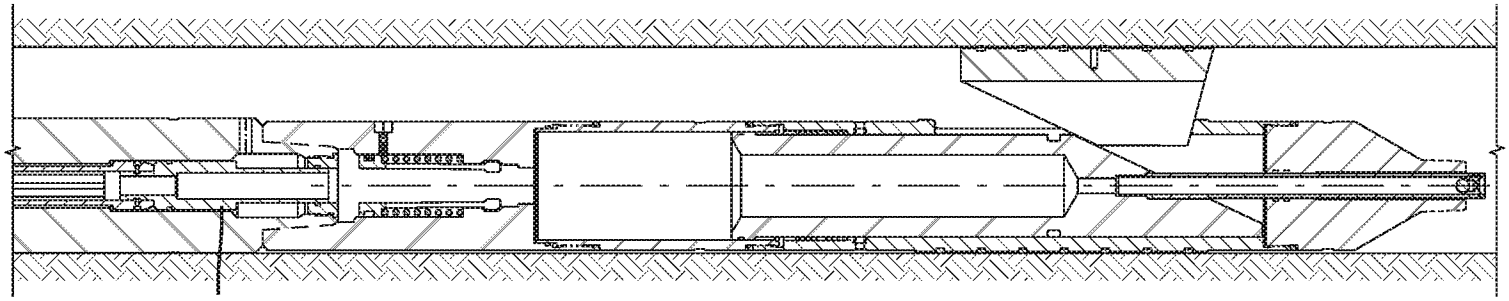
FIG. 25 shows the anchor set with pressure.
Figure 26:
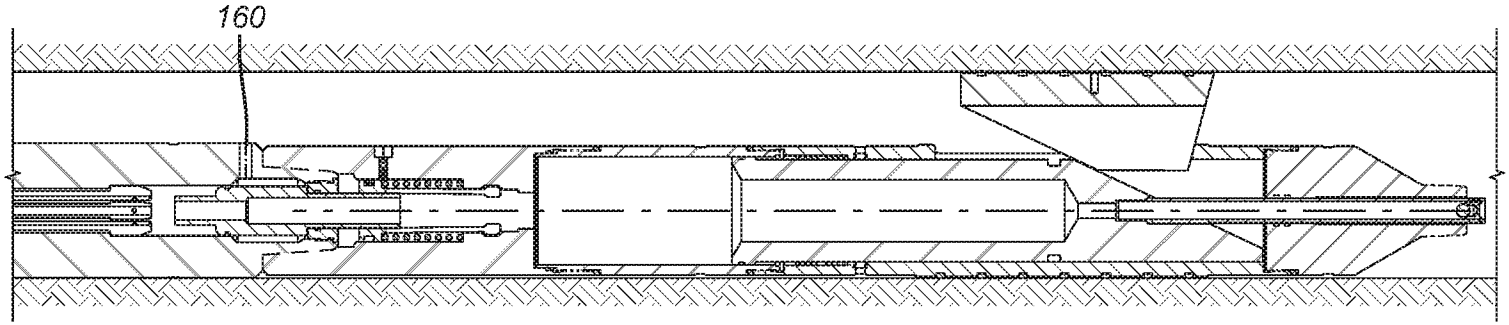
FIG. 26 shows the running tool collets released with higher pressure.
Figure 27:
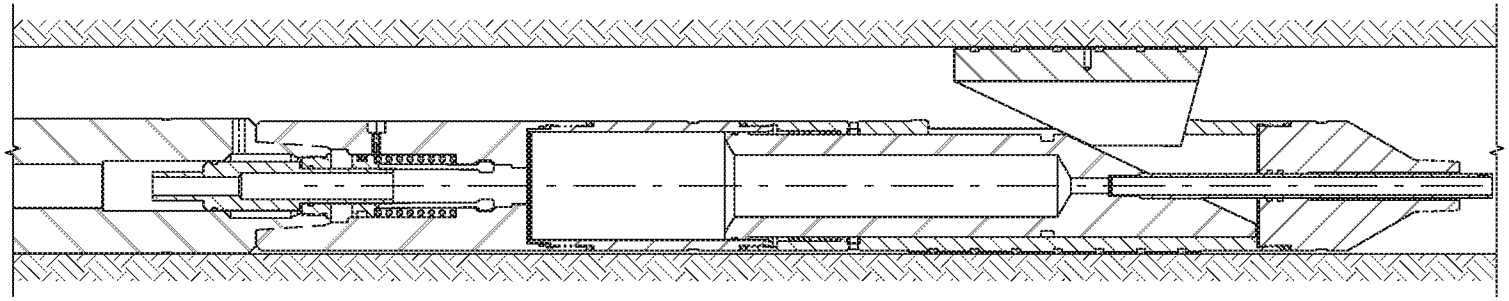
FIG. 27 shows the ball and seat blown out and the running tool removed after cementing.

FIG. 22 shows a bottom hole assembly 140 with an MWD unit 142, a whipstock 144 and an anchor 146. As before a running tool 148 passes through a whipstock passage to be retained at collet heads 150 by piston 152. Ball 154 is retained as shown in FIG. 17 and is selectively released as described before to land on seat 156. Pressure then sets anchor 146 as previously described and moves piston 152 to release collet heads 150 with applied pressure and no flow. This time movement of piston 152 is accomplished by using unequal opposed surfaces so that internal pressure puts a net downward force on piston 152 to shift it and release the collet heads 150. The ball 154 and the seat 156 then get blown out as before and the cementing takes place with the running tool 148 released. After the cementing the running tool 148 is pulled out as shown in FIG. 27. Passage 160 is provided to allow piston 152 to move due to the differential piston surfaces that create a net force down on piston 152 when pressure is applied.

Those skilled in the art will appreciate that the present invention accommodates an MWD bottom hole assembly in horizontal holes where a gyro cannot be used with wireline and allows release from the BHA with pressure or flow obviating the need for ball release to be able to use the MWD tool. In the past open hole whipstock placements were limited to wells that are more than 30 degrees from horizontal to get the gyro in position with wireline. "Horizontal borehole" is defined as oriented less than 30 degrees from horizontal. With more deviated wells the wireline delivered gyro was not workable. Inline MWD tool need circulation through them to operate and will not allow balls to pass for release from a BHA. In open hole applications the milling tools are not attached with a tab to the top of the whipstock. The present invention runs a running tool into a whipstock passage and releases the whipstock with flow or pressure. It also leaves a passage open through the BHA to enable cementing such as to secure an anchor in open hole. Backup options are provided for pressure actuation to enable flow if a ball on a seat does not blow clear. Balls are dropped onto a seat from below the MWD tool to allow a continuous flow path for proper MWD operation and to release an object after pressure on the object is released.

The above description is illustrative of the preferred embodiment and many modifications may be made by those skilled in the art without departing from the invention whose scope is to be determined from the literal and equivalent scope of the claims below:

We claim:

1. A bottom hole assembly (BHA), comprising:

an MWD tool;

an oriented tool assembly selectively connected to said MWD tool and releasable with fluid flow or fluid pressure applied via a through passage with said oriented tool supported in a wellbore; and wherein fluid flow or fluid pressure at a first predetermined rate shears a first shear pin to orient the oriented tool assembly and fluid flow or fluid pressure at a second predetermined rate shears a second shear pin to release the oriented tool assembly.

2. The assembly of claim 1, wherein:

said oriented tool assembly is selectively releasable with pressure.

3. The assembly of claim 1, wherein:

said oriented tool assembly is selectively releasable with flow.

4. The assembly of claim 1, wherein:

said oriented tool assembly comprises an open hole whipstock and associated anchor.

5. The assembly of claim 4, wherein:

flow through said passage at a first predetermined rate sets said anchor and flow through said passage at a second predetermined rate higher than said first predetermined rate releases said MWD tool from said whipstock.

6. The assembly of claim 5, wherein:

said first predetermined flow rate applies a force to a slip piston on said anchor to extend a slip radially for support of said whipstock.

7. The assembly of claim 6, wherein:

said force on said slip piston arises from said first predetermined flow rate passing through a first flow restriction associated with said slip piston.

8. The assembly of claim 7, wherein:

said second predetermined flow rate passing through a second flow restriction associated with a release piston to disconnect said whipstock from said MWD tool.

9. The assembly of claim 8, wherein:

movement of said release piston undermines at least one collet on a running tool supported from said MWD tool to allow release of the running tool from a bore in said whipstock.

10. A borehole method, comprising:

orienting a borehole tool with a flow actuated MWD tool with fluid flow or fluid pressure at a first predetermined rate to shear a first shear pin;

supporting said borehole tool in an oriented position;

releasing said MWD tool from said borehole tool with fluid flow or fluid pressure via a through passage at a second predetermined rate to shear a second shear pin.

11. The method of claim 10, comprising:

providing as said borehole tool an open hole whipstock and associated anchor;

flowing through said passage at a first predetermined rate to set said anchor and flow through said passage at a second predetermined rate higher than said first predetermined rate to release said MWD tool from said whipstock;

applying a force to a slip piston on said anchor to extend a slip radially for support of said whipstock with said first predetermined flow rate.

12. The method of claim 11, comprising:

creating said force on said slip piston from said first predetermined flow rate passing through a first flow restriction associated with said slip piston;

disconnecting said whipstock from said MWD tool with said second predetermined flow rate running through a second flow restriction associated with a release piston;

moving said release piston to undermine at least one collet on a running tool supported from said MWD tool to allow release of the running tool from a bore in said whipstock.

* * * * *